US005601020A

United States Patent [19]

Dawley et al.

[11] Patent Number: 5,601,020

[45] Date of Patent: Feb. 11, 1997

[54] APPARATUS FOR REDUCING PROCESSION OF A TUBULAR PRINTING SLEEVE

[75] Inventors: Douglas J. Dawley, Epping; James B. Vrotacoe, Rochester, both of N.H.

[73] Assignee: Heidelberger Druckmaschinen AG, Heidelberg, Germany

[21] Appl. No.: 470,564

[22] Filed: Jun. 6, 1995

Related U.S. Application Data

[60] Division of Ser. No. 209,779, Mar. 11, 1994, abandoned, which is a continuation-in-part of Ser. No. 7,453, Jan. 22, 1993, abandoned.

[51] Int. Cl.[6] ..... B41F 27/06; B41F 27/12; B41L 29/12

[52] U.S. Cl. ..... 101/217; 101/375

[58] Field of Search ..... 101/217, 218, 101/177, 131, 375, 376, 142, 143, 395, 396, 154, 375, 415.1, 378

[56] References Cited

U.S. PATENT DOCUMENTS

| | | | |
|---|---|---|---|
| 4,030,415 | 6/1977 | Fellows | 101/382 |
| 4,056,057 | 11/1977 | Smith | 101/415.1 |
| 4,144,813 | 3/1979 | Julian . | |
| 4,332,194 | 6/1982 | Gensheimer . | |
| 4,589,339 | 5/1986 | Fischer | 101/217 |
| 4,913,048 | 4/1990 | Tittgemeyer | 101/141 |
| 5,245,923 | 9/1993 | Vrotacoe | 101/217 |

FOREIGN PATENT DOCUMENTS

| | | |
|---|---|---|
| 8532300 U | 2/1986 | Germany . |
| 1401695 | 7/1973 | United Kingdom . |

*Primary Examiner*—J. Reed Fisher
*Attorney, Agent, or Firm*—Kenyon & Kenyon

[57] ABSTRACT

An apparatus for reducing procession of a gapless tubular printing sleeve in an offset printing press caused by at least one fluid wave having a certain pressure trapped at an interface of the printing sleeve and a cylinder on which it is mounted. The apparatus includes a cylinder which is adapted to receive the printing sleeve for mounting on its circumferential surface. The cylinder has at least one path which connects an interface of the cylinder and the printing sleeve to a region of pressure lower than the pressure in the fluid wave. The path allows the fluid wave, which is trapped at the interface and advancing in front of a nip between the cylinder and an adjacent cylinder, to escape to the region of low pressure.

8 Claims, 8 Drawing Sheets

APPARATUS FOR REDUCING PROCESSION OF A TUBULAR PRINTING SLEEVE

RELATED APPLICATIONS

This application is a division of U.S. Ser. No. 08/209,779, filed on Mar. 11, 1994, now abandoned which, in turn, is a continuation-in-part of U.S. Ser. No. 08/007,453 filed on Jan. 22, 1993, now abandoned.

FIELD OF THE INVENTION

The present invention relates to offset printing presses and more particularly to an apparatus for reducing procession of a gapless tubular printing sleeve mounted on a cylinder.

BACKGROUND OF THE INVENTION

In offset printing, printed images are transferred from printing plates mounted on plate cylinders to a moving web of material by transfer cylinders known as blanket cylinders. Typically, printing blankets are mounted on the blanket cylinders which have a rubber surface for transferring the printed images. Conventional printing plates and printing blankets are rectangular in shape and are mounted in axial gaps extending along the circumferential surfaces of the corresponding plate cylinders and blanket cylinders. One problem with this design is that at high operational speeds the gaps in the plate and blanket cylinders cause vibrations in the printing press which have the effect of varying the optical densities of the printed image. There are a number of other problems associated with this design which affects the quality of the final printed product. Many of these problems have been solved by making the printing blanket tubular in shape having a gapless outer circumferential surface. Furthermore, by substituting the conventional flat printing plate with a tubular printing form having a gapless outer circumferential surface endless printing is possible. Arrangements of this nature however have several drawbacks.

To mount a tubular printing sleeve, i.e., a tubular printing form or a tubular printing blanket, an air canal is provided at one end of a corresponding cylinder on which the sleeve is to be mounted. The canal supplies pressurized air radially outward through a plurality of passages. As the printing sleeve is placed over the passages, the pressure from the exiting air radially expands the printing sleeve enabling it to be axially mounted onto the circumferential surface of the corresponding cylinder. Since the inner circumference of the printing sleeve is slightly smaller than the outer circumference of the corresponding cylinder, once the printing sleeve is mounted it is stressed in tension by the corresponding cylinder to provide a tight pressure relationship between the printing sleeve and the corresponding cylinder. This pressure relationship fixes the printing sleeve on the corresponding cylinder so that there is no relative movement therebetween during operation of the press.

A problem with this arrangement is that air gets trapped at the interface of the printing sleeve and the corresponding cylinder. During operation of the press this trapped air creates a continually advancing wave in front of a nip between the corresponding cylinder and an adjacent cylinder against which it is pressed causing the printing sleeve to bulge. This phenomena is known as printing sleeve procession. It creates defects in the printed product by forming latent double images.

Several attempts have been made to reduce or eliminate sleeve procession, but none have been successful. One attempted solution was to increase interference between the printing sleeve and corresponding cylinder. Another was to change the material combination of the printing sleeve and the corresponding cylinder surface to a combination having higher coefficients of friction. Both of these attempted solutions failed, since the primary cause of procession does not involve slippage of the printing sleeve relative to the corresponding cylinder.

Another attempted solution was to decrease the normal forces between the corresponding cylinder and its adjacent cylinders. Although this solution reduces the rate of procession, it also reduces the quality of print to an unacceptable level. Still another solution was attempted which involved mechanically fixing the printing sleeve to the corresponding cylinder. This attempt was also unsuccessful because the printing sleeve was too thin to withstand the forces required to stop the procession, and hence the printing sleeve would tear.

The deficiencies in each of these attempts are fundamental and cannot be eliminated.

OBJECTS AND SUMMARY OF THE INVENTION

An object of the present invention is to provide an apparatus that removes fluid waves that cause printing sleeve procession.

The present invention provides an apparatus for reducing procession of a gapless tubular printing sleeve in an offset printing press caused by at least one advancing fluid wave having a certain pressure, comprising: a cylinder adapted to receive the printing sleeve for mounting on its circumferential surface; and means for connecting an interface of the cylinder and the printing sleeve to a region of pressure lower than the pressure in the fluid wave to allow the fluid wave, which is trapped at the interface and advancing in front of a nip between the cylinder and an adjacent cylinder, to escape to the region of low pressure.

In one embodiment of the present invention, the means for connecting the interface of the cylinder and the printing sleeve to a region of low pressure comprises the cylinder having at least one groove extending along its circumferential surface, the trapped fluid wave escaping via the groove.

In another embodiment of the present invention, the means for connecting the interface of the cylinder and the printing sleeve to a region of low pressure comprises the printing sleeve having at least one groove extending along its inner circumferential surface, the trapped fluid wave escaping via the groove.

In a further embodiment of the present invention, the means for connecting the interface of the cylinder and the printing sleeve to a region of low pressure comprises a plurality of small granular particles having spaces formed therebetween, the trapped fluid wave escaping via the spaces.

An advantage of the present invention is that it removes the trapped fluid wave that causes procession of the printing sleeve without reducing the quality of the final printed product.

Another advantage of the present invention is that it eliminates latent double images and hence improves the overall quality of the final printed product.

A further advantage of the present invention is that it removes the trapped fluid wave within several rotations of the cylinder so that the printing operation may proceed almost immediately after mounting the printing sleeve.

These and other objects, characteristics, and advantages of the present invention will become apparent in view of the description and accompanying drawings that follow.

DETAILED DESCRIPTION

Figure 1:
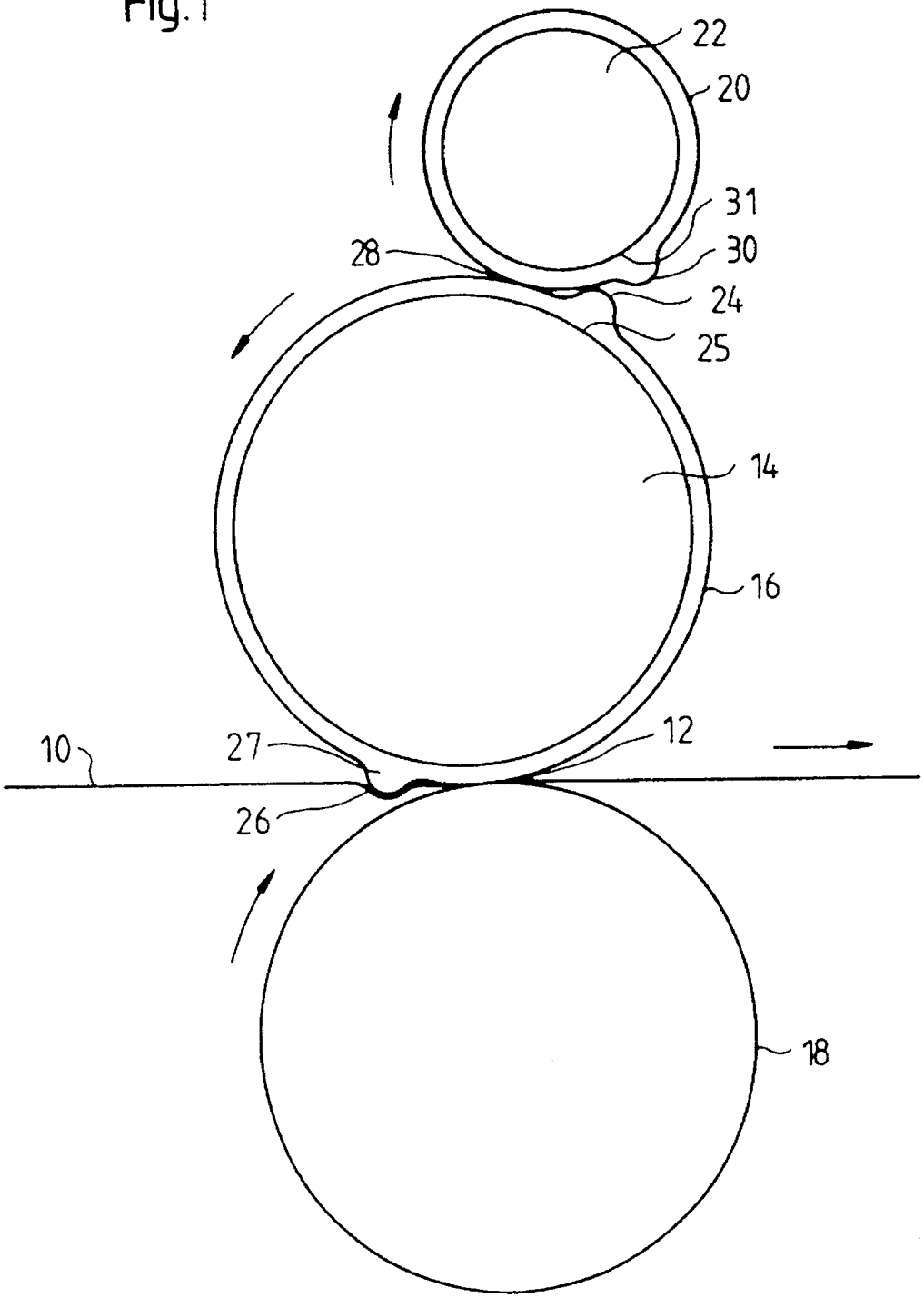
FIG. 1 is a representational side view of a prior art offset printing press showing procession of a tubular printing form and tubular printing blanket caused by fluid waves.

FIG. 1 shows a web material 10 passing through a nip 12 between a blanket cylinder 14, having a gapless tubular printing blanket 16 mounted thereon, and an impression cylinder 18 in an offset printing press. It should be understood that to achieve printing on both sides of the web material 10, the impression cylinder 18 could be replaced by another blanket cylinder having a printing blanket mounted thereon. The printing blanket 16 transfers printed images from a tubular printing form 20 mounted on a print form cylinder 22 to the web material 10.

During operation of the printing press, bulges 24 and 26 form in the printing blanket 16. They are caused by fluid waves 25 and 27 advancing in front of a nip 28 between the blanket cylinder 14 and the print form cylinder 22 and the nip 12 between the blanket cylinder 14 and the impression cylinder 18, respectively. Furthermore, a bulge 30 forms in the printing form 20. It is caused by a fluid wave 31 advancing in front of the nip 28 between the blanket cylinder 14 and the print form cylinder 22. The fluid waves 25, 27 and 31 are created by air trapped during mounting of the printing blanket 16 onto the blanket cylinder 14 and the printing form 20 onto the print form cylinder 22, respectively. This trapped air has a pressure that creates the bulges 24, 26 and 30 in front of the nips 28 and 12.

Figure 2:
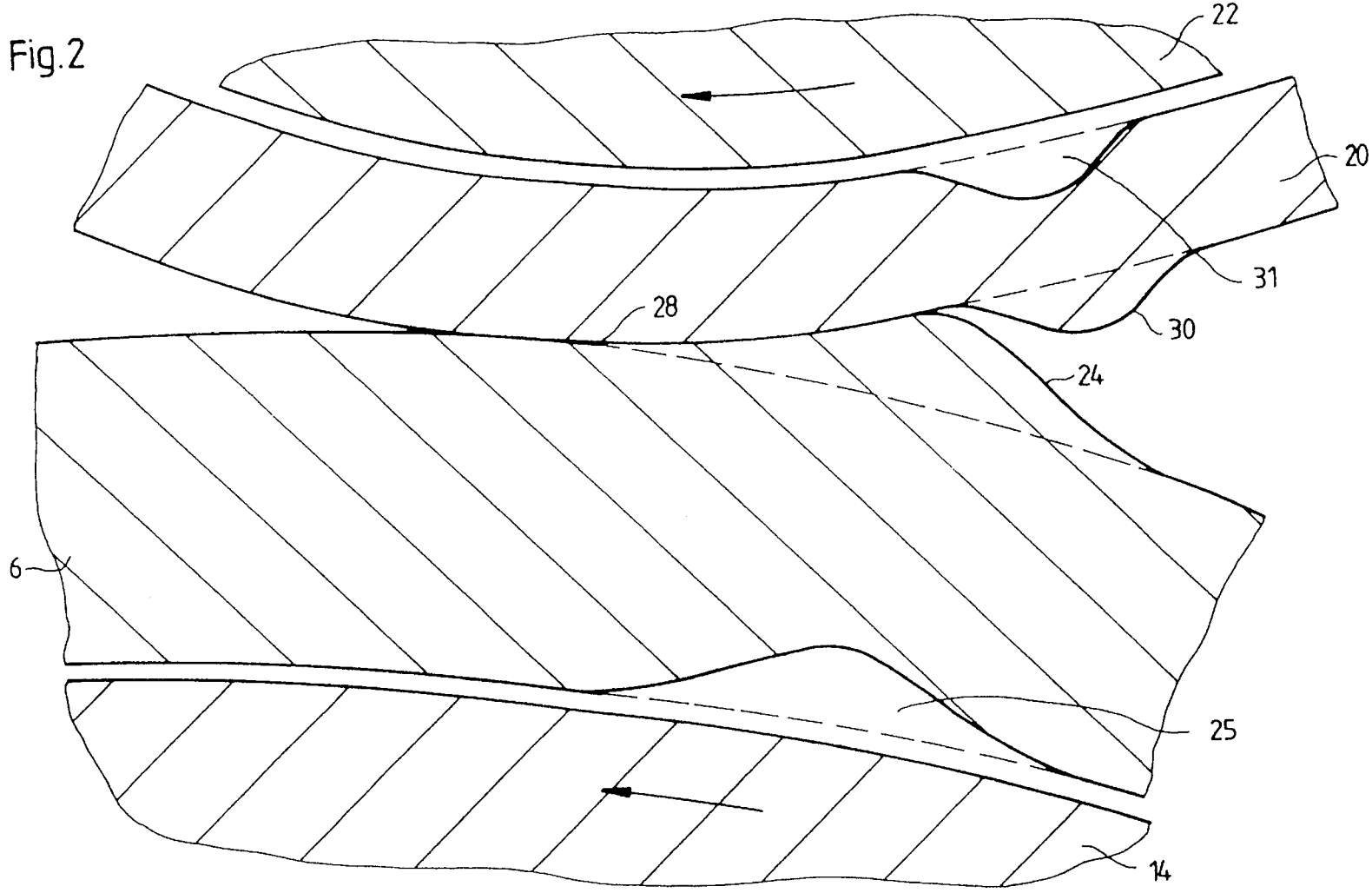
FIG. 2 is an exploded view of adjacent fluid waves advancing in front of a nip between a print form cylinder and a blanket cylinder of the printing press shown in FIG. 1.

The effect of the fluid wave 25 will now be described with reference to FIG. 2. The fluid wave 25 advances continuously around the blanket cylinder 14 causing the printing blanket 16 to move relative to the blanket cylinder with each revolution. This motion causes the image transferred onto the printing blanket 16 to be in a different position relative to the printing form 20 every revolution. The distance between any given image transferred onto the printing blanket 16 and a previous revolution's latent image imprinted on the printing blanket causes two images to be printed on the web material 10, i.e., a double image. This double image is an undesirable printing defect. It should be understood that fluid waves 27 and 31 have similar effects.

By removing fluid waves 25 and 27, any relative motion between the printing blanket 16 and blanket cylinder 14 is virtually undetectable and does not cause a printing defect. Likewise, by removing the fluid wave 31 as well as other fluid waves (not shown) advancing in front of nips formed between the print form cylinder 22 and inker and dampener rollers (not shown), any relative motion between the printing form 20 and the print form cylinder 22 is virtually undetectable and does not cause a printing defect.

The present invention is directed to an apparatus for removing the fluid waves that create the bulges in the printing blanket 16 and the printing form 20. Generally speaking, it provides a path along which the advancing fluid waves (trapped air) can escape from beneath the printing sleeve, i.e., printing blanket 16 or printing form 20. It is contemplated that the system for removing the trapped fluid which constitutes the present invention can utilize any geometry that will allow the fluid to flow from an interface of the printing sleeve and its corresponding cylinder, i.e., blanket cylinder 14 or print form cylinder 22, to an area of pressure lower than the hydrodynamic pressure in the fluid waves.

Figure 3:
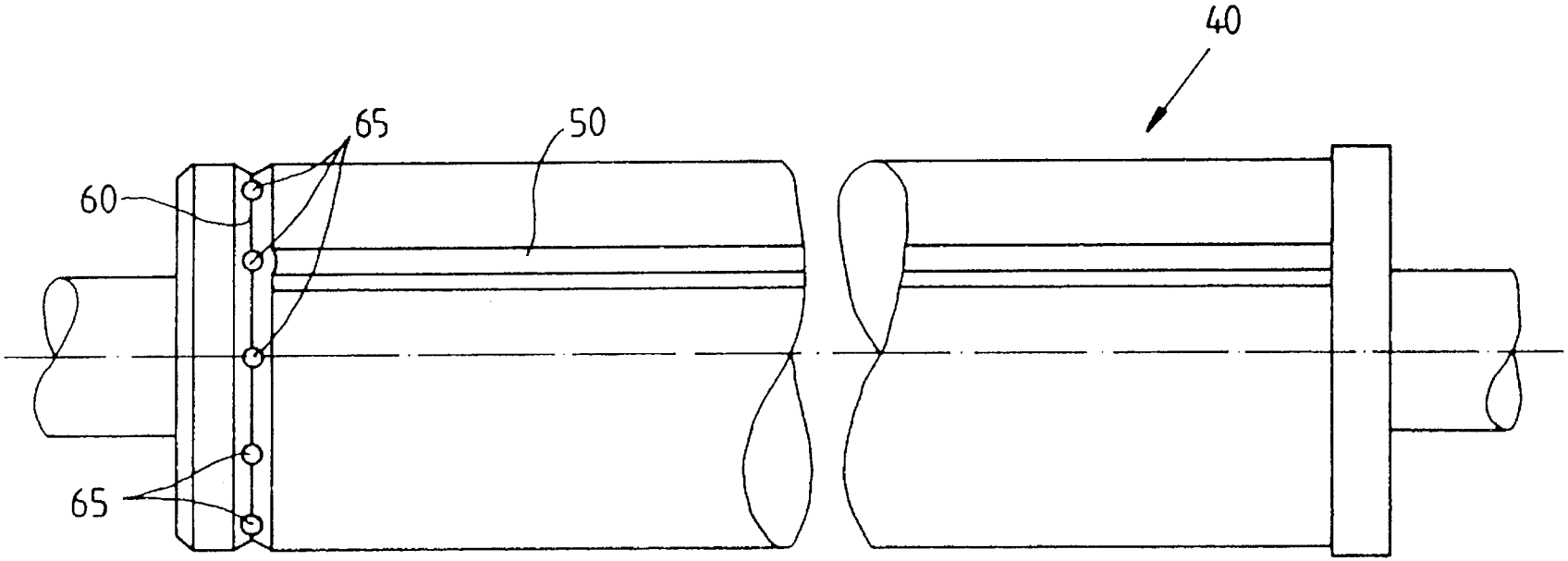
FIG. 3 is a perspective view of one embodiment of the present invention showing a cylinder having a groove extending straight across its circumferential surface.

One embodiment of the present invention provides a cylinder having at least one groove of any orientation. FIG. 3 shows one such arrangement wherein a cylinder 40 is provided which has a groove 50 extending straight across the circumferential surface of the cylinder. The groove 50 connects the interface of the cylinder 40 and a printing sleeve (not shown) mounted thereon to an air canal 60. The air canal 60 supplies pressurized air through passages 65 to radially expand the printing sleeve so that it can be mounted onto the cylinder 40. However, during operation of the printing press, the air canal 60 can be vented to the atmosphere so that the fluid waves can escape to a region of low pressure via the groove 50.

Figure 4:
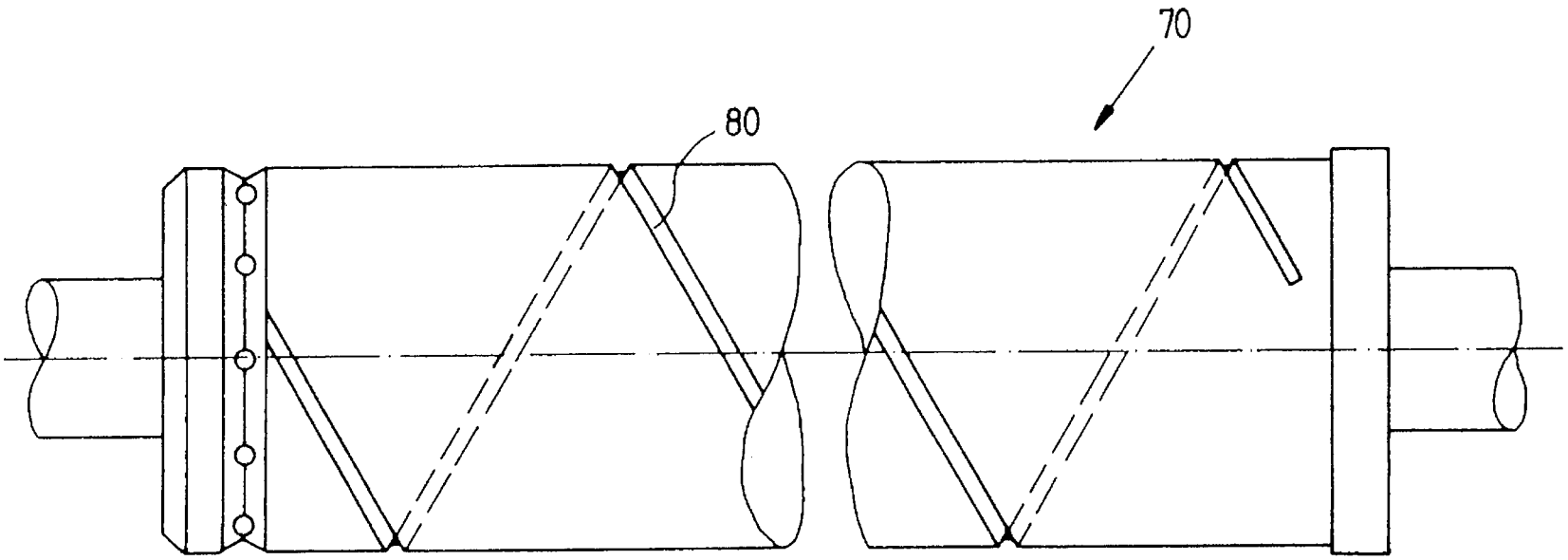
FIG. 4 is a perspective view of another embodiment of the present invention showing a cylinder having a groove extending helically around and across the circumferential surface of the cylinder.

FIG. 4 shows a related embodiment wherein a cylinder 70 is provided which has a groove 80 extending helically around and across the circumferential surface of the blanket cylinder. Although FIGS. 3 and 4 show a single straight groove and a single helical groove, a plurality of such grooves may be provided which may or may not interconnect with one another. Furthermore, the present invention is not limited to these configurations. The grooves 50 and 80 may be of any geometrical configuration and have any cross-section.

Figure 5:
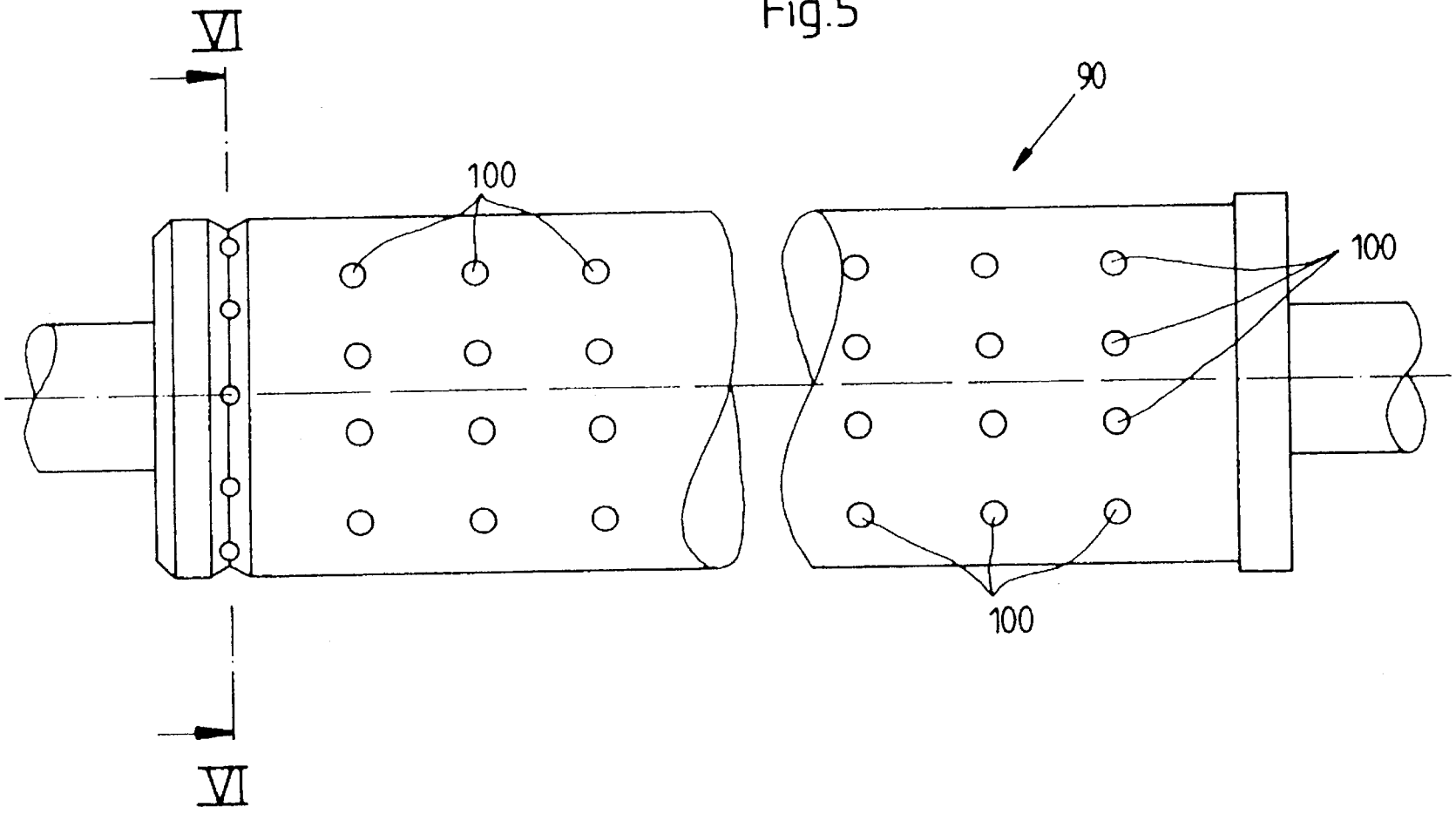
FIG. 5 is a perspective view of another embodiment of the present invention showing a cylinder having a plurality of discrete holes disposed on its circumferential surface.

Another embodiment of the present invention is shown in FIG. 5 wherein a cylinder 90 has a plurality of discrete holes 100 which connect an interface of the cylinder 90 and a printing sleeve 105 (shown in FIG. 6) mounted thereon to a region of low pressure.

Figure 6:
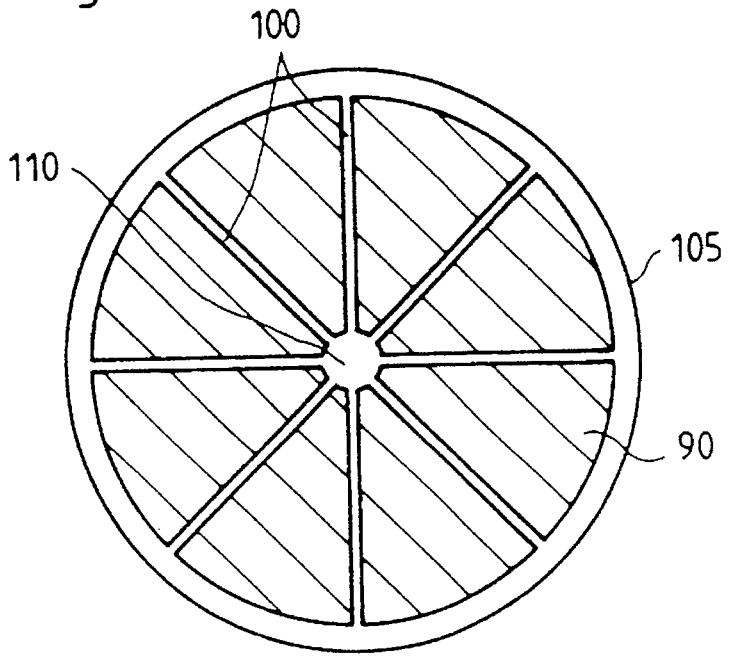
FIG. 6 is a side view of the cylinder of FIG. 5 showing the holes leading from the circumferential surface of the cylinder to a channel.

FIG. 6 shows the plurality of holes 100 leading from the circumferential surface of the cylinder 90 leading into a channel 110 which feeds into an air canal (not shown) which, as with the embodiments in FIGS. 3 and 4, vents to the atmosphere during operation of the printing press. This embodiment is not limited to the arrangement shown in FIGS. 5 and 6. Rather, any arrangement of holes may be used and the holes may be of any geometrical configuration.

Figure 7:
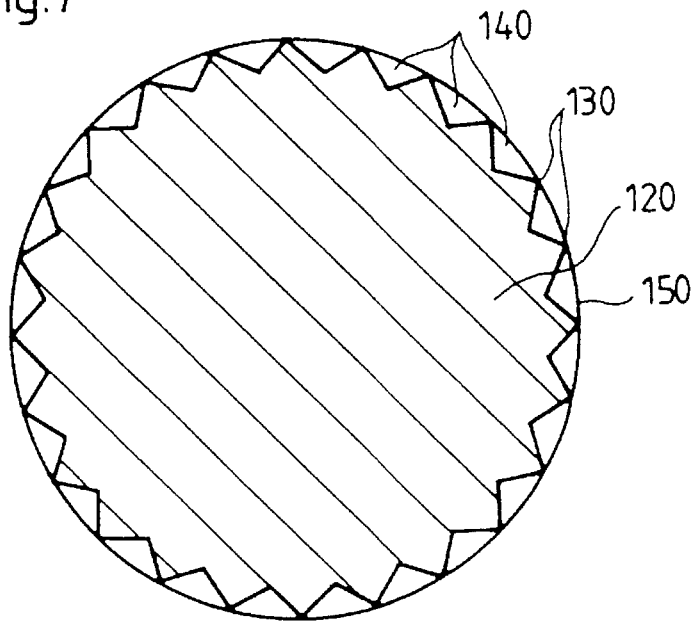
FIG. 7 is a side view of a further embodiment of the present invention showing a cylinder having a rough circumferential surface, the contour of which is defined by peaks and valleys.

FIG. 7 shows still another embodiment of the present invention. In this embodiment, a cylinder 120 is provided which has a rough circumferential surface, the contour of which is defined by peaks 130 and valleys 140. The peaks 130 and valleys 140 may be formed by a plurality of knurls. The valleys 140 connect the interface of the cylinder 120 and a printing sleeve 150 mounted thereon to a region of pressure lower than that of the advancing fluid wave. The printing sleeve 150 rides the peaks 130 allowing the trapped fluid waves to escape via the valleys 140.

Figure 8:
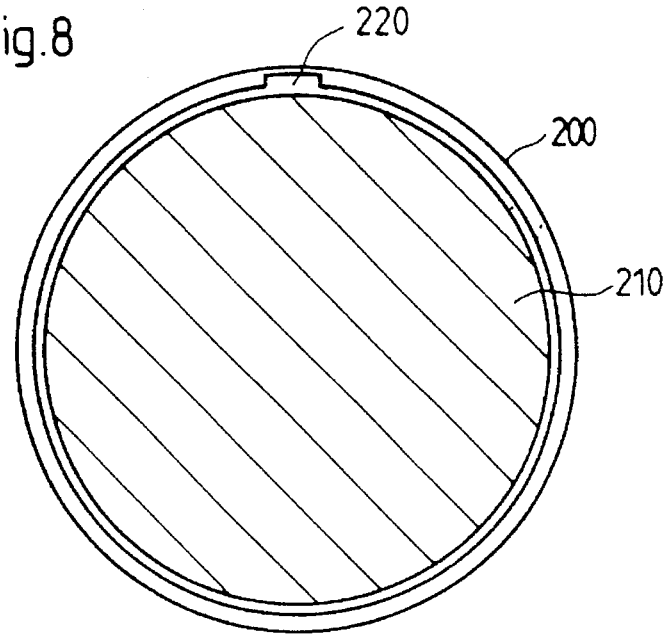
FIG. 8 is a side view of a further embodiment of the present invention showing a tubular gapless printing sleeve having a groove extending along its inner circumferential surface.

FIG. 8 shows an other embodiment of the present invention. In this embodiment, a tubular gapless printing sleeve 200 is provided which is mounted on a cylinder 210. The printing sleeve 200 has a groove 220 extending along its inner circumferential surface. The groove 220 connects the interface of the printing sleeve 200 and the cylinder 210 to a region of low pressure providing a path along which the trapped fluid waves can escape. As with the grooves 50 and 60 in the embodiments shown in FIGS. 3 and 4, the groove 220 may be of any geometrical configuration and have any cross-section. Furthermore, a plurality of such grooves may be provided which may or may not interconnect with one another. The inner circumferential surface of the printing sleeve 200 may also have a rough contour defined by peaks and valleys, wherein the trapped fluid waves escape via the valleys.

Figure 9:
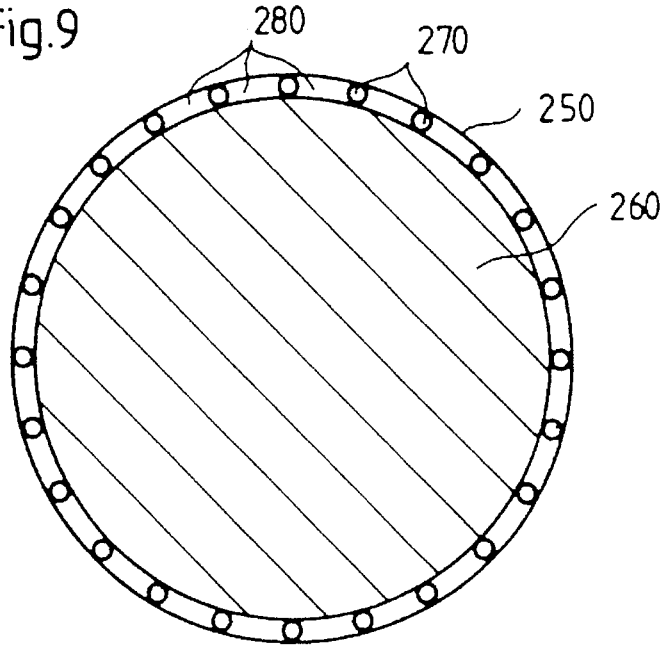
FIG. 9 is a side view of another embodiment of the present invention showing a plurality of small granular particles at the interface of a cylinder and printing sleeve mounted thereon.

FIG. 9 shows still another embodiment of the present invention wherein a tubular gapless printing sleeve 250 is provided which is mounted on a cylinder 260. In this embodiment, a foreign substance, e.g., small granular particles 270 such as talc, is introduced at the interface of the printing sleeve 250 and the cylinder 260. The printing sleeve 250 rides on the small granular particles 270 allowing the trapped fluid to escape via spaces 280 formed between the particles to a region of low pressure. The small granular particles 270 may be of any geometric configuration such that the spaces 280 formed between the particles allow the trapped fluid to escape to the region of low pressure.

Figure 9A:
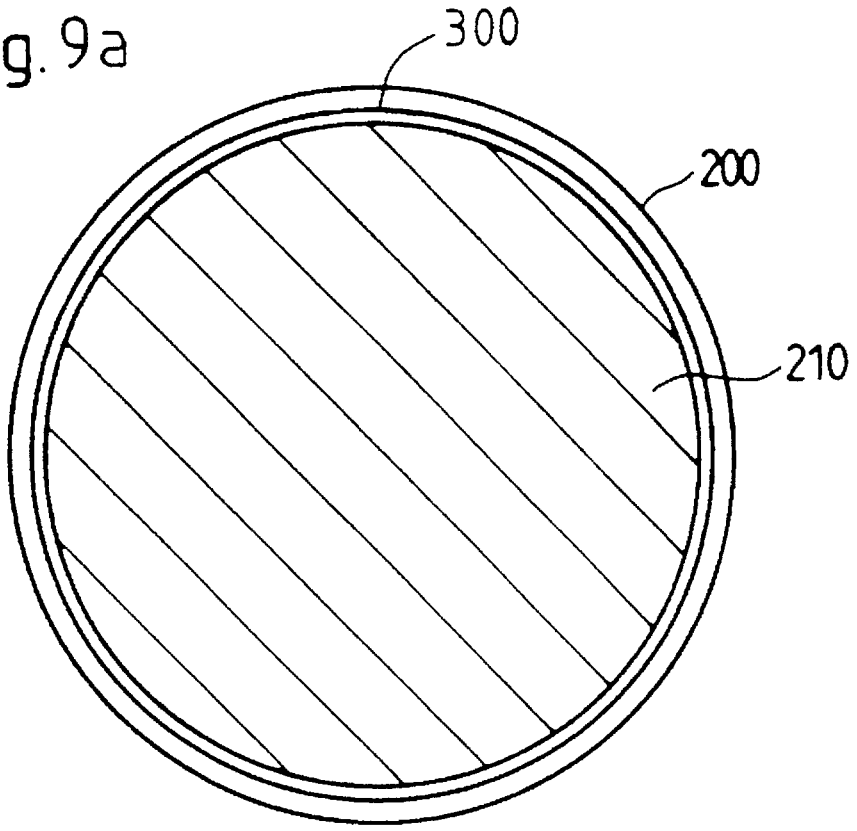
FIG. 9A is a side view of an alternate embodiment of the embodiment shown in FIG. 9 wherein a flat sheet of mylar is disposed at the interface of the cylinder and the printing sleeve mounted thereon.

The foreign substance introduced at the interface of the printing sleeve 250 and the cylinder 260 may also be a flat sheet of mylar 300, the edges of which, butt together forming an air canal for the pressure in the wave to escape, as shown in FIG. 9A.

It is to be understood that for each embodiment described herein, the region to which the trapped fluid flows could be the atmosphere, a generated vacuum, or any other region with a pressure lower than that of the advancing fluid waves.

While the present invention is capable of various modifications and alternate constructions, it is not intended to limit the invention to the specific embodiments disclosed herein. Rather, it is intended to cover all modifications and alternative constructions falling within the spirit and scope of the invention as expressed in the claims.

We claim:

1. An apparatus for reducing procession of a gapless tubular printing sleeve in a printing press caused by at least one fluid wave trapped between the printing sleeve and a cylinder, the apparatus comprising:

a gapless tubular printing sleeve;

a cylinder having a circumferential surface adapted to receive and mount the gapless tubular printing sleeve;

means for connecting an interface of the cylinder and the gapless printing sleeve to a region of pressure lower than the pressure in the fluid wave to allow the fluid wave, which is trapped at the interface and advancing in front of a nip between the cylinder and an adjacent cylinder, to escape to the region of low pressure;

wherein the connecting means includes the cylinder having the circumferential surface with a rough contour defined by peaks and valleys, the printing sleeve riding on the peaks and the fluid wave escaping via the valleys.

2. The apparatus according to claim 1, wherein the peaks and valleys which define the rough contour of the circumferential surface of the cylinder are formed by a plurality of knurls.

3. The apparatus according to claim 1, wherein the printing sleeve is a tubular printing form.

4. The apparatus according to claim 1, wherein the printing sleeve is a tubular printing blanket.

5. The apparatus according to claim 1, further comprising:

an adjacent cylinder, wherein the fluid wave between the cylinder and the printing sleeve is circumferentially located in front of a nip between the cylinder and the adjacent cylinder.

6. The apparatus according to claim 5, wherein the adjacent cylinder is an impression cylinder.

7. The apparatus according to claim 5, wherein the adjacent cylinder is a blanket cylinder.

8. The apparatus according to claim 5, wherein the adjacent cylinder is a print form cylinder.

* * * * *